US007699166B2

(12) United States Patent
Gauger et al.

(10) Patent No.: US 7,699,166 B2
(45) Date of Patent: Apr. 20, 2010

(54) PACKAGE FOR WIPES

(75) Inventors: Jeremy Thaddeus Gauger, Appleton, WI (US); Robert Samuel Schlaupitz, New London, WI (US); Paul R. Schmidt, Portage, MI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 292 days.

(21) Appl. No.: 11/513,498

(22) Filed: Aug. 31, 2006

(65) Prior Publication Data

US 2008/0053859 A1 Mar. 6, 2008

(51) Int. Cl.
*B65D 69/00* (2006.01)
*B65D 73/00* (2006.01)

(52) U.S. Cl. ..... 206/233; 206/229; 206/494; 206/812

(58) Field of Classification Search ..... 206/484, 206/484.1, 484.2, 494, 812, 233; 383/38, 383/43, 66
See application file for complete search history.

(56) References Cited

U.S. PATENT DOCUMENTS

| | | | | | |
|---|---|---|---|---|---|
| 2,287,581 | A | | 6/1942 | Walker | |
| 3,063,487 | A | * | 11/1962 | Mullin | 150/150 |
| 3,489,194 | A | * | 1/1970 | Hoover | 383/4 |
| 4,131,195 | A | * | 12/1978 | Worrell, Sr. | 206/205 |
| 4,341,307 | A | * | 7/1982 | Shyers | 206/472 |
| 4,411,374 | A | | 10/1983 | Hotchkiss | |
| 4,420,080 | A | * | 12/1983 | Nakamura | 206/449 |
| 4,564,108 | A | * | 1/1986 | Widlund et al. | 206/438 |
| 4,566,130 | A | * | 1/1986 | Coates | 383/15 |
| 4,651,874 | A | * | 3/1987 | Nakamura | 206/205 |
| 4,790,436 | A | | 12/1988 | Nakamura | |
| 4,886,150 | A | * | 12/1989 | Fitzsimmons | 190/1 |
| 4,979,613 | A | * | 12/1990 | McLaughlin et al. | 206/233 |
| 5,242,057 | A | * | 9/1993 | Cook et al. | 206/581 |
| 5,464,096 | A | | 11/1995 | Hurwitz | |
| 5,484,636 | A | * | 1/1996 | Berg et al. | 428/41.8 |
| 5,544,750 | A | * | 8/1996 | Randall | 206/494 |
| 5,579,916 | A | * | 12/1996 | Manko | 206/581 |
| 5,616,337 | A | | 4/1997 | Kasianovitz et al. | |
| 5,623,980 | A | * | 4/1997 | McMahon | 150/150 |
| 5,778,954 | A | | 7/1998 | Sullivan et al. | |
| 6,026,953 | A | * | 2/2000 | Nakamura et al. | 206/233 |

(Continued)

FOREIGN PATENT DOCUMENTS

| | | | |
|---|---|---|---|
| DE | 1806287 | A1 | 7/1969 |
| DE | 20313489 | U1 | 10/2003 |
| EP | 1588682 | A1 | 10/2005 |
| WO | WO 0242176 | A1 | 5/2002 |

OTHER PUBLICATIONS

PCT Search Report from International Application No. PCT/IB2007/052817 dated Mar. 4, 2008.
English language abstract for DE 20313489U1 dated Oct. 23, 2003.
English language abstract for DE 1806287A1 dated Jul. 31, 1969.

*Primary Examiner*—Ehud Gartenberg
*Assistant Examiner*—Jose S Stephens, III
(74) *Attorney, Agent, or Firm*—Dority & Manning, P.A.

(57) ABSTRACT

A package for carrying and dispensing wipes is described. The package has a wallet-like configuration and includes a first compartment separated from a second compartment along a foldable seam. The package can be configured to carry any suitable wipes including facial tissue, bath tissue, and any suitable pre-moistened wipes.

28 Claims, 6 Drawing Sheets

U.S. PATENT DOCUMENTS

| | | | | |
|---|---|---|---|---|
| 6,062,381 | A | 5/2000 | Paley et al. | |
| 6,065,591 | A | 5/2000 | Dill et al. | |
| 6,126,009 | A * | 10/2000 | Shiffler et al. | 206/494 |
| 6,168,022 | B1 | 1/2001 | Ward | |
| 6,357,592 | B1 * | 3/2002 | Coia | 206/472 |
| 6,428,867 | B1 | 8/2002 | Scott et al. | |
| 6,454,096 | B1 * | 9/2002 | Kondoh et al. | 206/494 |
| 6,523,690 | B1 | 2/2003 | Buck et al. | |
| 6,550,635 | B1 | 4/2003 | King et al. | |
| 6,589,622 | B1 | 7/2003 | Scott | |
| 6,705,541 | B2 | 3/2004 | Schuehrer et al. | |
| 6,715,594 | B2 * | 4/2004 | Milionta et al. | 190/110 |
| 6,766,919 | B2 | 7/2004 | Huang et al. | |
| 6,851,550 | B2 | 2/2005 | Bishop et al. | |
| 6,913,146 | B2 * | 7/2005 | Bechyne et al. | 206/440 |
| 6,978,889 | B2 * | 12/2005 | McBride | 206/210 |
| 7,204,368 | B2 * | 4/2007 | Cheaure et al. | 206/440 |
| 7,377,395 | B1 * | 5/2008 | Mak | 206/581 |
| D573,459 | S * | 7/2008 | Snider et al. | D9/423 |
| 2002/0014467 | A1 * | 2/2002 | Reidenbach | 215/237 |
| 2002/0084204 | A1 * | 7/2002 | Dilnik et al. | 206/494 |
| 2002/0170911 | A1 * | 11/2002 | Lafond et al. | 220/23.4 |
| 2005/0011906 | A1 | 1/2005 | Buck et al. | |
| 2007/0272588 | A1 * | 11/2007 | Longacre | 206/581 |

* cited by examiner

PACKAGE FOR WIPES

BACKGROUND OF THE INVENTION

Various different types of disposable wiping products are currently available on the market. Such wiping products can include, for instance, facial tissues, bath tissues, paper towels, napkins, and the like. In addition to dry products, saturated or pre-moistened wiping products have also gained in popularity in the recent past.

Saturated or pre-moistened wiping products are used in a variety of different wiping and polishing applications. For instance, pre-moistened wipes are commonly sold in a stack of individual, folded sheets packaged in a plastic container for use as baby wipes. In other applications, the wipes are treated with an antibacterial agent and packaged as a sanitary wiper.

Pre-moistened wipes are also produced containing a disinfectant and/or a cleaning composition. In these applications, the pre-moistened wipes are used to clean and disinfect adjacent surfaces, such as countertops, flooring, and bathroom surfaces.

Pre-moistened products are also constructed that disintegrate when placed in water over a period of time. These products are marketed as being "flushable" down a standard commode. Such pre-moistened wipes are gaining in popularity as a replacement to dry bath tissue.

Wiping products, such as those described above, are packaged in various different formats. For instance, the wiping products can be packaged in containers made from plastic or from paperboard. The package can be configured to contain a relatively large number of wipes or, for some pre-moistened wipes, configured to only contain a single wipe. What is needed, however, is a package for carrying a relatively small amount of wipes for individual use. For instance, in some applications, a need exists for a package for pre-moistened wipes that can be discretely carried by an individual. Such a package, for instance, may be particularly well suited to holding flushable pre-moistened wipes.

SUMMARY OF THE INVENTION

In general, the present disclosure is directed to a package for carrying wipes. In one embodiment, for instance, the package includes a first compartment containing a first stack of wipes and a second compartment containing a second stack of wipes. The second compartment can have a length and a width that are substantially similar to the length and width of the first compartment.

The first compartment is connected to the second compartment along a foldable seam. In particular, the first compartment is foldable onto the second compartment about the seam. When in a folded configuration, an inner surface of the first compartment faces an inner surface of the second compartment.

A first opening is located on the inner surface of the first compartment for withdrawing wipes therethrough and a second opening is located on the inner surface of the second compartment for withdrawing wipes therethrough.

In one embodiment, the package can have a wallet-like configuration. Each compartment can contain from about 1 wipe to about 25 wipes, such as from about 5 wipes to about 20 wipes. Although the size and shape of the package can vary depending upon the particular application, in one embodiment, the length and width of each compartment can be from about 2 inches to about 6 inches.

In general, any suitable wiping product may be contained in the first compartment or the second compartment. The wiping product may be, for instance, a facial tissue, a bath tissue, and the like. The product that is contained in the first compartment may be the same or different than the product that is contained in the second compartment. In one particular embodiment, the first compartment and the second compartment both contain pre-moistened wipes.

If desired, the opening defined by the first compartment and the opening defined by the second compartment can be resealable. For instance, in one embodiment, the openings can be covered by an adhesive label that can be peeled and resealed. The adhesive label may comprise a film defining a peelable member surrounded by a frame portion. The peelable member can be attached to the frame portion along a fold line. In one particular embodiment, the peelable member may include a tab portion that extends beyond the perimeter of the frame portion.

In an alternative embodiment, each opening may be covered by a polymeric member that defines a slit. The polymeric member may be constructed such that the slit forms an opening when the polymeric member is compressed in a direction generally parallel to the slit.

In still another embodiment, each opening may include a first side and a second side. The first side may be surrounded by a groove, while the second side may be surrounded by a ridge. The groove and the ridge may form an interlocking fit. In this embodiment, a closing member may be present in order to facilitate the mechanical interlock between the groove and ridge. In particular, the closing member may function like a zipper in that it may slide along the groove and ridge forcing the two structures together. Alternatively, the groove and ridge can be closed by sliding a finger along the opening.

In still another embodiment, the first and second openings can be located on the first and second compartments so as to overlap when the package is folded. The package can include a sealing member that seals the first opening to the second opening when the package is folded. For instance, the sealing member may comprise a female portion positioned adjacent the first opening and a male portion that is positioned adjacent to the second opening. The female portion may form an interlock fit with the male portion when the package is folded. For example, the female portion may comprise a groove, while the male portion comprises a ridge that fits within the groove.

The package can generally be made from any suitable material. In one embodiment, for instance, the package may be made from a polymer film material. The polymer film material may comprise a multi-layered polymer film. For instance, the polymer film may include a sealable layer that faces the wipes within the compartments and an opposite outside layer. Optionally, a core layer may also be present that is positioned in between the sealable layer and the outside layer. The core layer may be more rigid than the sealable layer and outside layer for providing support to the product.

The sealable layer can be made from any suitable thermoplastic polymer that is capable of fusing when subjected to, for instance, heat or ultrasonic energy. The sealable layer, for instance, may be made from a polyolefin polymer, a polyolefin copolymer, or an ethylene vinyl acetate copolymer. The outside layer, on the other hand, may comprise a polyolefin polymer or a copolymer thereof. The outside layer may be printed with graphics and can also be embossed.

The present disclosure is also directed to a process for producing a package for wipes. The process can include the steps of placing a first stack of wipes on a first portion of a blank and placing a second stack of wipes on a second portion of the blank. The blank can include a first end, a second end, and a middle portion. The middle portion may be located between the first portion and the second portion. The blank can comprise a polymer film material.

The first end of the blank can be folded over the first stack of wipes and the free edges of the first end may be attached to the blank. For instance, once folded over the stack of wipes, the free edges of the first end can be thermally bonded or ultrasonically bonded to the blank. Likewise, the second end of the blank can be folded over the second stack of wipes and attached to the blank.

A first opening can be formed in the first end of the blank for withdrawing the first stack of wipes from the first compartment and a second opening can be formed in the second end of the blank for withdrawing the second stack of wipes from the second compartment.

If desired, a score line can be formed along the middle portion of the blank so as to facilitate folding of the first compartment onto the second compartment. In addition, the middle portion can also be perforated for separating the first compartment from the second compartment if a consumer desires to do so.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
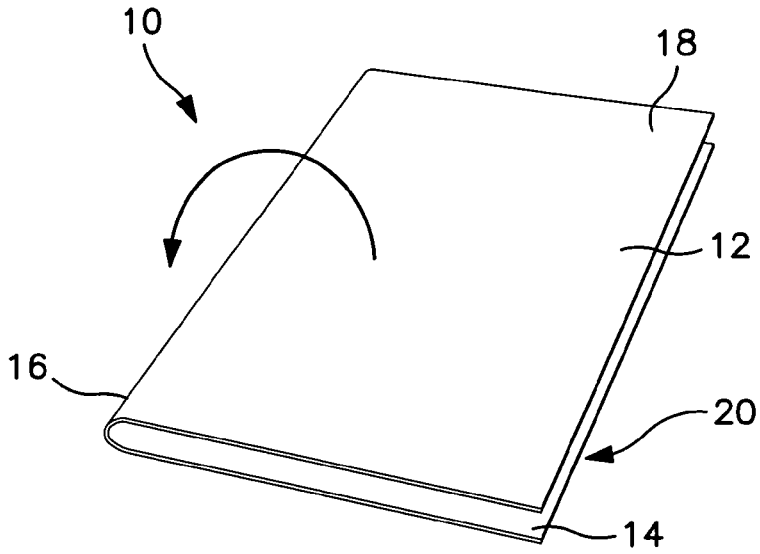
FIG. 1 is a perspective view of one embodiment of a package for carrying wipes in accordance with the present disclosure.

Repeat use of reference characters in the present specification and drawings is intended to represent the same or analogous features or elements of the present disclosure.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a package for carrying wipes. The package can contain, for instance, two compartments that each carry a separate stack of wipes. The wipes contained in the package can be, for instance, facial tissues, napkins, paper towels, and pre-moistened wipes including pre-moistened bath tissue. In one embodiment, the first compartment can be attached to the second compartment along a foldable seam. Thus, when folded, the package has a wallet-like shape and style.

Of particular advantage, the package is not only configured to contain two different stacks of wipes, but can also carry the wipes in a relatively discrete manner. For instance, the package can be made to be relatively compact and can be provided with different textures and graphics that, if desired, can have an overall look that is much different than conventional facial tissue packages, baby wipe packages, and the like.

Figure 2:
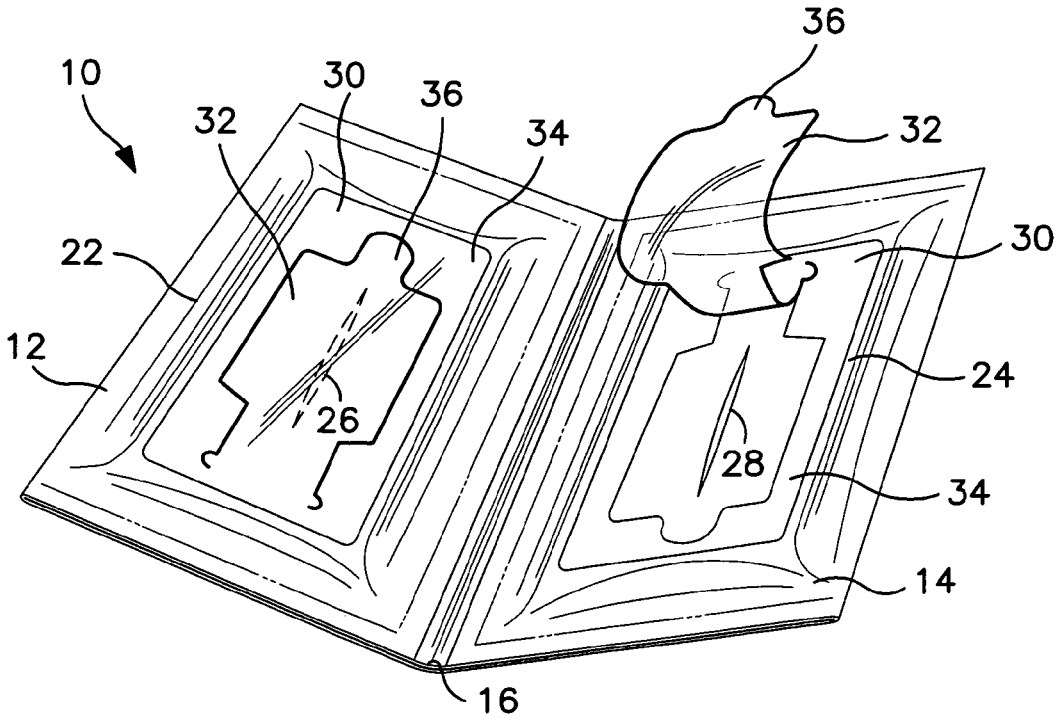
FIG. 2 is another perspective view of the package illustrated in FIG. 1.

Referring to FIGS. 1 and 2, for example, one embodiment of a package 10 made in accordance with the present disclosure is illustrated. As shown, the package 10 includes a first compartment 12 attached to a second compartment 14 along a seam 16. The seam 16 is configured to be foldable. In this regard, the seam 16 can be made from a flexible material and/or can include a score line to facilitate folding of the package. In one embodiment, the seam 16 can define a perforation line that not only facilitates folding but allows the user to separate the first compartment 12 from the second compartment 14.

As shown in FIG. 1, the first compartment 12 includes an outside surface 18, while the second compartment 14 includes an outside surface 20. When the package 10 is opened as shown in FIG. 2, the first compartment 12 defines an interior surface 22 that faces an interior surface 24 of the second compartment 14. The interior surface 22 of the first compartment 12 defines a first opening 26, while the interior surface 24 of the second compartment 14 defines a second opening 28. The first and second openings 26 and 28 are for dispensing wipes from the package 10.

As shown in FIG. 2, the openings 26 and 28 are generally in the shape of slits. It should be understood, however, that the openings can have any suitable configuration depending upon the particular application. For example, in other embodiments, the openings may have an oval shape, a round shape, a rectangular shape, or the like.

When dispensing dry wipes, the package 10 may need no further structures in addition to the openings 26 and 28. In some applications, especially when at least one of the compartments contains pre-moistened wipes, however, the openings 26 and 28 can be resealable. For example, as shown in FIG. 2, in one embodiment, an adhesive label 30 is placed over each of the openings 26 and 28 that is peelable and resealable. In the particular embodiment illustrated in FIG. 2, the adhesive label 30 includes a peelable member 32 surrounded by a frame portion 34. At least the frame portion 34 is securely attached to the inside surface of the package. In addition, the peelable member 32 can also include an adhesive that can be peeled away and reattached to the inside surface.

In the embodiment illustrated in FIG. 2, in order to access one of the openings 26 or 28, a tab portion 36 on one of the peelable members 32 can be grasped by a user in order to fold the peelable member back and expose the underlying opening. Once a wipe is removed from the opening, the peelable member 32 can then be folded back into a closed position for resealing the package.

The adhesive label 30 as shown in FIG. 2 can be made from any suitable material. For instance, the adhesive label 30 can be made from a plastic film, a multi-layered film, a coated paper or paperboard, and the like. In one embodiment, the adhesive label 30 is made from a relatively rigid plastic film. The film, for instance, can be made from a polymer having a density of at least 1.2 g/cc, such as greater than about 1.3 g/cc. The polymer used to form the adhesive layer can be, for instance, a polyolefin, a polyester, or any other suitable material.

In one embodiment, the adhesive label 30 can be transparent or translucent. If desired, various graphics can be printed onto the label. For instance, the label can be printed with instructions or with aesthetic designs. In one particular embodiment, for instance, the label 30 can be printed with designs that may match the exterior surface of the package.

Examples of labels that may be used with the package of the present disclosure are disclosed, for instance, in U.S. Pat. No. 6,428,867 and in U.S. Pat. No. 6,589,622, which are both incorporated herein by reference. Such labels, for instance, may be obtained commercially from Prime Label and Screen, Inc. of Pewaukee, Wis.

Figure 3A:
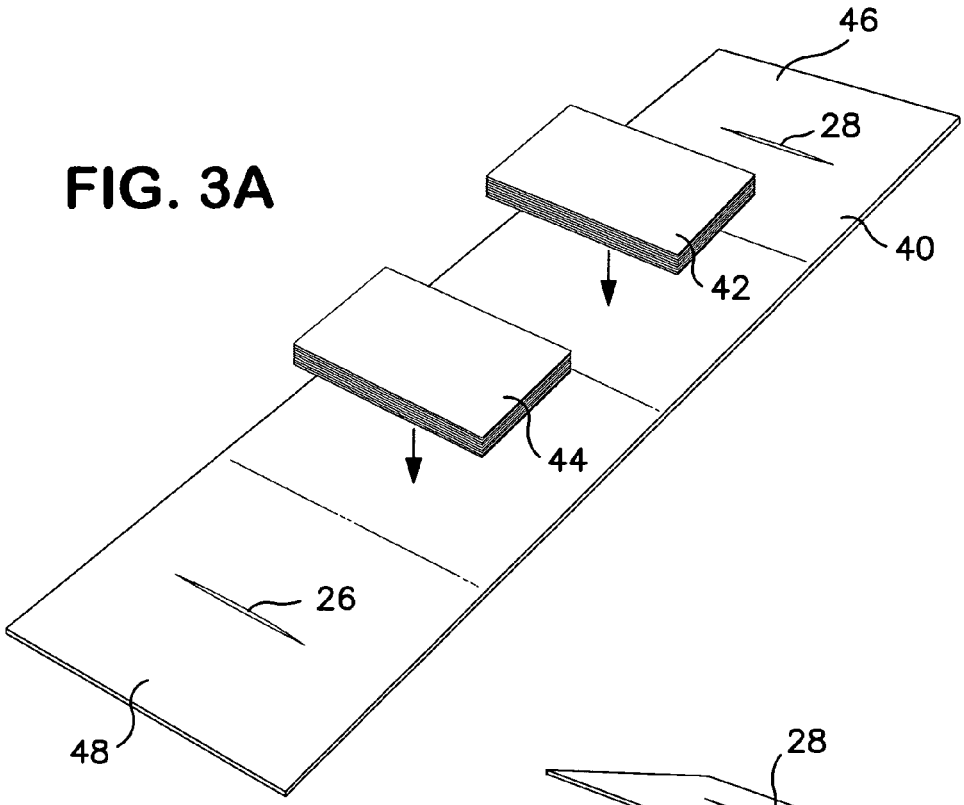
FIGS. 3A through 3C are perspective views illustrating one embodiment of a process for forming the package illustrated in FIGS. 1 and 2.
Figure 3B:
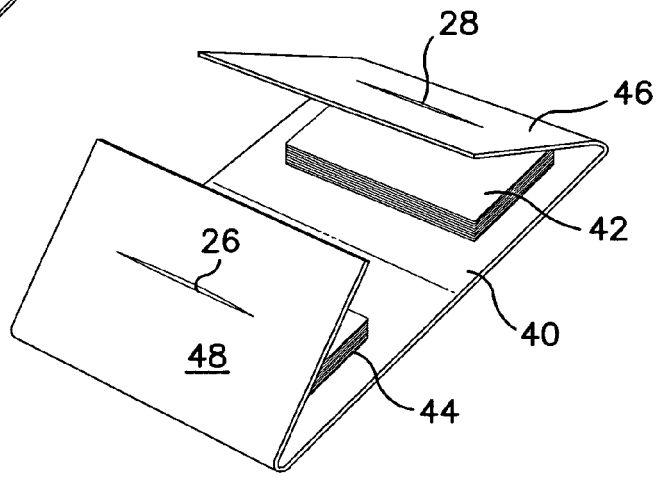
Figure 3C:
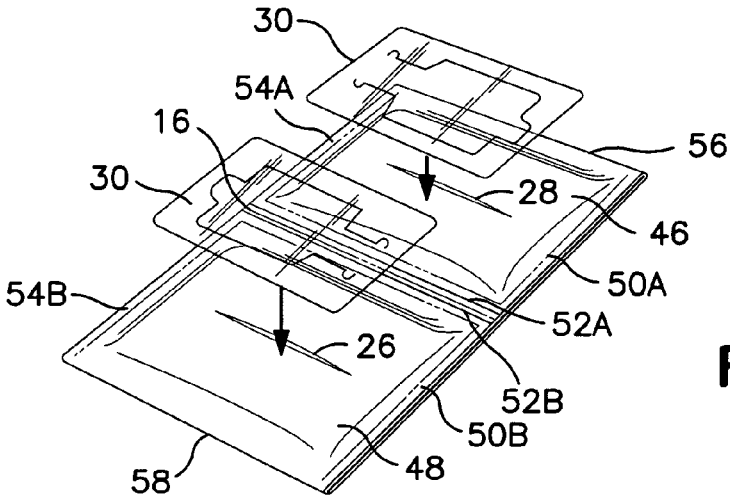

Referring to FIGS. 3A through 3C, one embodiment of a process for producing the package 10 as shown in FIGS. 1 and 2 is illustrated. For instance, as shown in FIG. 3A, the package 10 can be made from a single one-piece blank 40. In one embodiment, for example, the one-piece blank 40 can be made from a polymer film. The polymer film can be unwound from a parent roll and cut to a desired length. In addition, the openings 26 and 28 can be formed into the blank.

As shown in FIG. 3A, a first stack of wipes 42 and a second stack of wipes 44 are placed on the blank 40. The wipes 42 and 44 can comprise any suitable wiping product, such as facial tissues, napkins, bath tissue, baby wipes, disinfectant wipes, industrial wipers, and the like. As described above, in one embodiment, the first stack of wipes 42 and the second stack of wipes 44 comprise pre-moistened wipes. Further, it should be understood that the first stack of wipes 42 and the second stack of wipes 44 can be the same product or can be different products. For example, in one embodiment, the first stack of wipes 42 may comprise pre-moistened bath tissue, while the second stack of wipes 44 may comprise pre-moistened antimicrobial wipes. In another embodiment, the first stack of wipes may comprise premoistened wipes, while the second stack of wipes may comprise a substantially dry product, such as facial tissues or bath tissues.

Each stack of wipes can comprise separate sheets or can comprise a continuous length of material in which each sheet is separated by perforations.

When stacked as separate sheets, the individual sheets can be separately folded and stacked on top of each other. Alternatively, the sheets can be interfolded.

The number of sheets contained in the first stack 42 and/or in the second stack 44 can vary dramatically depending upon the particular application. For exemplary purposes only, each stack may contain only a single wipe or may contain more than 30 wipes. In one embodiment, for instance, each stack may contain from about 4 wipes to about 25 wipes, such as from about 8 wipes to about 20 wipes. In one particular application, for instance, each stack may contain from about 10 wipes to about 15 wipes, such as about 12 wipes.

The number of wipes in each stack can vary depending upon the particular application of the product. For instance, when holding a lower amount of wipes, the package can be made relatively compact. In this embodiment, the dimensions of the package may be relatively small and may be used as a purse pack, a pocket pack, and the like for on-the-go convenience. When formed into a wallet-like size, for instance, the length and width of the package, for instance, may vary from about 2 inches to about 6 inches.

In other embodiments, however, the package can be configured to hold relatively large amounts of wipes. In this embodiment, the package may be for carrying relatively large amounts of baby wipes or larger counts of other types of similar wiping products.

As shown in FIG. 3A, each stack of wipes 42 and 44 are placed on the blank 40 towards the middle of the blank. The blank 40 includes a first end portion 46 and a second end portion 48. As shown in FIG. 3B, after the stacks of wipes are placed on the blank, each end portion is then folded over on top of the stacks of wipes. In this manner, the opening 26 is placed on top of the stack 44, while the opening 28 is placed on top of the stack 42.

After the end portions 46 and 48 are folded over the stacks of wipes 42 and 44, the free edges of the end portions are then attached to the blank for creating the two separate compartments. The manner in which the edges of the end portions are attached to the blank may vary depending upon the types of material used to form the blank. For instance, in one embodiment, an adhesive may be used in order to attach the edges to the blank. Alternatively, the free edges of the end portions may be thermally or ultrasonically bonded to the blank. More particularly, as shown in FIG. 3C, edges 50A, 52A, and 54A of the first end portion 46 are sealed to the blank to form a sealed compartment. Likewise, edges 50B, 52B, and 54B of the second end portion 48 are also sealed to the blank to form another sealed compartment.

Of particular advantage, by folding the end portion 46 over onto the blank, a folded edge 56 is formed. Similarly, the second end portion 48 forms a second folded edge 58. The folded edges 56 and 58 are relatively soft to the touch and increase not only the comfort but the aesthetics of the resulting package.

As shown in FIG. 3C, a seam 16 is formed in between the first compartment and the second compartment. In one embodiment, the first and second end portions may be folded so that neither end portion overlaps the seam 16. In this manner, the seam is only made from one layer of material and thus may be more easily foldable. If desired, the seam 16 can include a score line to facilitate folding and/or may also include a perforation line. By adding a perforation line, the first compartment may be detached from the second compartment if desired by a user.

As shown in FIG. 3C, once the sealed compartments are formed into the package, a resealable device may be placed over each of the openings 26 and 28. For instance, in the example shown in FIG. 3C, an adhesive label 30 is placed over each opening.

In the embodiments shown in FIGS. 3A through 3C, the package 10 is made from a single blank 40. It should be understood, however, that in other embodiments the package may be made from two different blanks. For instance, two separate blanks may be used to form two separate compartments. The two compartments can then be joined together to form a seam.

The one or more blanks used to form the package 10 can be made from any suitable material. For instance, the blank can be made from a single layer of material or from multiple layers of material. Materials that may be used to form the blank include woven materials, knitted materials, nonwoven materials such as meltblown webs or spunbond webs, plastic films, laminates thereof, and the like.

In one embodiment, for instance, the blank 40 can be made from a multi-layered polymer film. The film may include, for instance, a sealable layer that is placed in contact with the stack of wipes and is particularly well suited for thermally or ultrasonically bonding to itself. In addition, the multi-layered plastic film can also include an outside layer that may have particular characteristics that improve the aesthetics of the package. Optionally, the multi-layered film can also include a core layer that is positioned in between the sealable layer and the outside layer.

The sealable layer, for example, can be made from a polyolefin, such as a low density polyethylene or a polypropylene. The sealable layer can also be made from an ethylene vinyl acetate copolymer or from any other suitable thermoplastic polymer.

The core layer when present, on the other hand, may comprise any material capable of providing some rigidity to the product. The core layer, for instance, may comprise a paper layer, a foil, or a polymer layer, such as a polypropylene or polyester. When using a foil layer as the core layer, the foil may have a thickness of from about 25 gauge to about 48 gauge.

The outside layer, on the other hand, can comprise any suitable polymer film, such as a polyethylene or a polypropylene. The outside layer may contain various softening additives and anti-slip agents, such as a diene that softens the polymer to give it a patina-like feel. In one embodiment, the outside layer can be made from a polymer film that is capable of accepting an ink. Alternatively, the outside layer may be coated with an ink adhering coating. In this manner, various aesthetically pleasing graphics can be applied to the package as may be desired.

In one embodiment, the outside layer may be embossed in order to further soften the layer and to provide the package with some texture.

As described above, the stack of wipes 42 and 44 that may be contained within the package can vary depending upon the particular application. For instance, the package may be configured to hold facial tissues, napkins, paper towels, and the like. The package is also particularly well suited to holding pre-moistened wipes. The pre-moistened wipes may comprise, for instance, flushable pre-moistened wipes, baby wipes, disinfectant wipes, and the like.

In the embodiment illustrated in FIG. 2, the openings 26 and 28 are made to be resealable by placing a resealable device over the openings. In the embodiment illustrated in FIG. 2, for instance, an adhesive label is placed over each opening that includes a frame portion and a peelable member. It should be understood, however, that various other resealable devices may be incorporated into the package.

For example, referring to FIGS. 4A through 4H, various other embodiments of resealable devices that may be used in accordance with the present disclosure are illustrated. Like reference numerals have been used to indicate the same or similar elements.

Figure 4A:
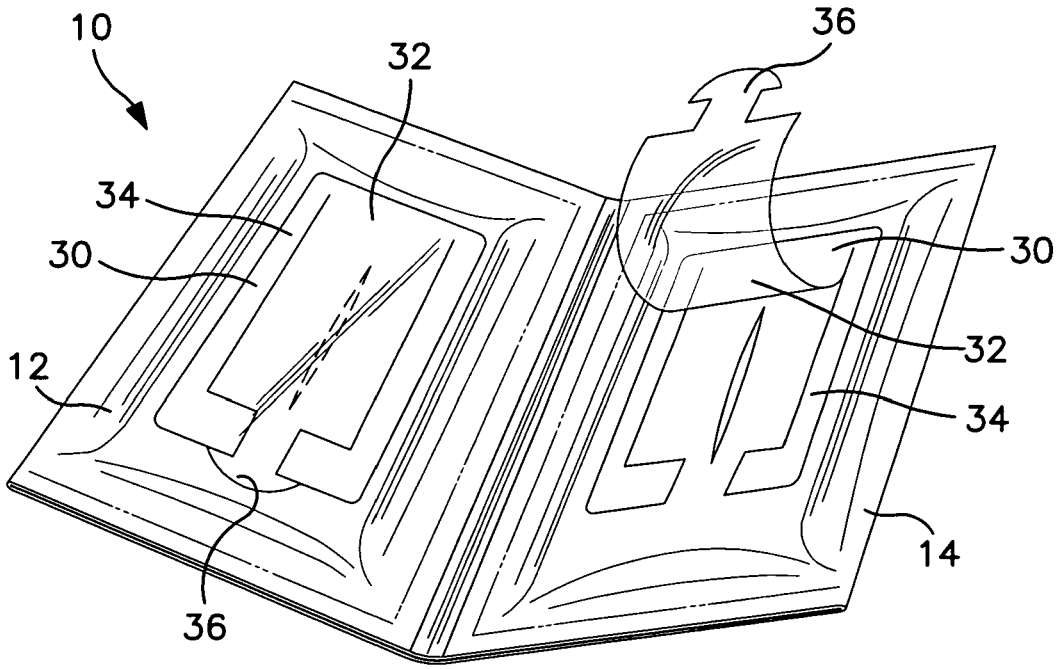
FIG. 4A is a perspective view of another embodiment of a package made in accordance with the present disclosure.

Referring to FIG. 4A, for instance, the package 10 includes adhesive labels 30 similar to the adhesive labels illustrated in FIG. 2. For instance, as shown in FIG. 4A, the adhesive labels 30 include a frame portion 34 that surrounds a peelable member 32. In this embodiment, however, the peelable members include tab portions 36 that extend beyond a perimeter of the frame portion 34. In this manner, the tab portions 36 may be easy to grasp for opening the resealable device.

Figure 4B:
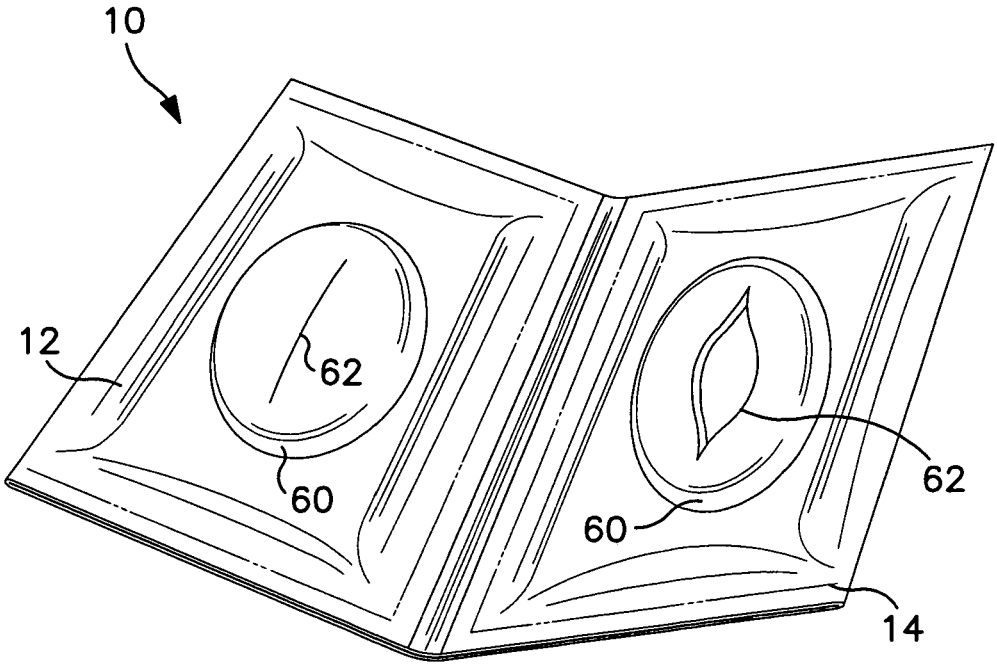
FIG. 4B is a perspective view of still another embodiment of a package made in accordance with the present disclosure.

Referring to FIG. 4B, still another embodiment of a sealable device that may be placed over the openings contained on the package 10 is shown. In this embodiment, the resealable device includes a polymeric member 60 defining a slit 62. The polymeric member 60 can be comprised of a somewhat rigid polymer. For instance, in one embodiment, the polymeric member 60 can be formed through injection molding. When the polymeric member is compressed in a direction generally parallel to the slit 62, the slit forms an opening as shown on the second compartment 14 for dispensing wipes therethrough. Once the compressive force is released, the opening then returns to the form of a slit and reseals itself.

If desired, a reinforcing rib can be formed into the polymeric member 60 along its perimeter. The rib may further facilitate the opening of the slit when a compressive force is applied to the polymeric member.

In one embodiment, the polymeric member 60 can be formed from a rubber-like sheet. The rubber-like sheet can have material properties that can be described in terms of the hardness, stiffness, thickness, elasticity, specific gravity, compression set and any combination thereof.

More specifically, the Shore A hardness (as measured by ASTM D2240) of the flexible, rubber-like sheet or material can be about 100 or less, more specifically from about 20 to about 90, and still more specifically from about 40 to about 80, and yet more specifically from about 60 to about 70.

The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf.

The thickness of the flexible, rubber-like sheet can be about 10 mil or greater, more specifically from about 10 mil to about 110 mil, and still more specifically from about 35 mil to about 60 mil.

The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (MPa) or less, more specifically from about 0.1 to about 7 MPa, and still more specifically from about 0.5 to about 2.5 MPa.

The flexible rubber-like sheet can have a specific gravity (per ASTM D792) of about 0.80 to 1.21, more specifically 0.88 to about 1.10, and still more specifically from about 0.90 to about 1.0. The flexible rubber-like sheet can have a compression set (per ASTM 395B) of (at room temperature/at 70 degrees C.) about 8/30 to 40/120 and more specifically 15/45 to about 28/100.

An example of some such flexible sheet-like materials include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton™, Santoprene™, or other rubber modifiers; Kraton™; Santoprene™; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based. One such material for the flexible, rubber-like sheet could be that manufactured by the GLS-Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.090 g/cc (per ASTM D792); hardness (Shore A durometer) of 68 (ASTM D2240); and compression set of 24% at room temperature, 96% at 70 deg. C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with ¼% wax additive sold by GLS Corporation and known as #LC217-189 can be used.

Figure 4C:
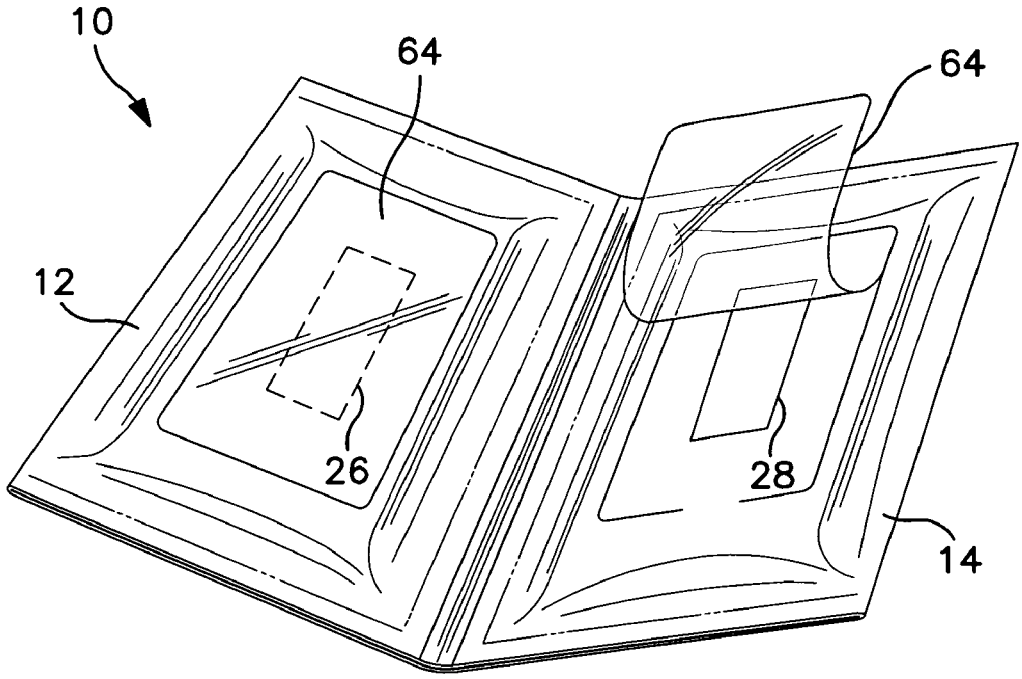
FIG. 4C is a perspective view of another embodiment of a package made in accordance with the present disclosure.

Referring to FIG. 4C, still another embodiment of a sealing device that may be used in accordance with the present disclosure is illustrated. In this embodiment, the resealing device comprises adhesive labels that may be peeled and resealed. Adhesive labels can be formed from any suitable polymeric material or can be formed from a coated paper. As shown in this embodiment, the openings 26 and 28 have a generally rectangular shape located below each of the adhesive labels.

Figure 4D:
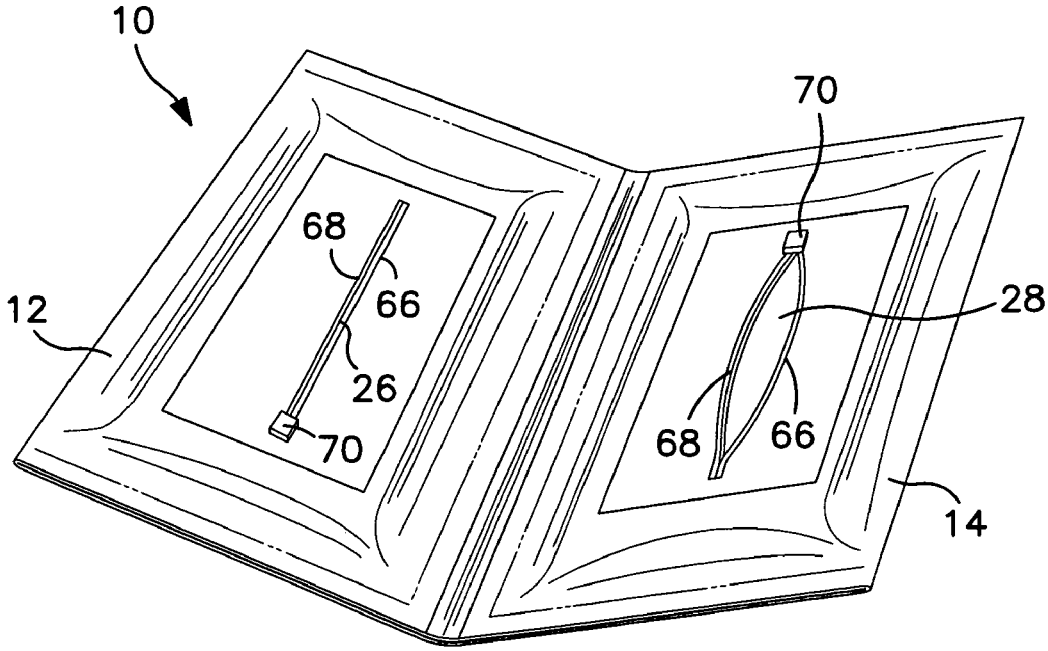
FIG. 4D is a perspective view of yet another embodiment of a package made in accordance with the present disclosure.

Referring to FIG. 4D, still another embodiment of a sealing member that may be incorporated into the package of the present disclosure is illustrated. As shown, in this embodiment, the openings 26 and 28 are surrounded by an interlocking groove and ridge structure. In particular, the sealing member includes a ridge 66 positioned on one side of the opening and a groove 68 positioned on the opposite side of the opening. When pressed together, the groove fits within the ridge to form an interlocking connection that can be watertight. In one embodiment, as shown in FIG. 4D, a zipper element 70 can be included for facilitating closure of the opening.

Figure 4E:
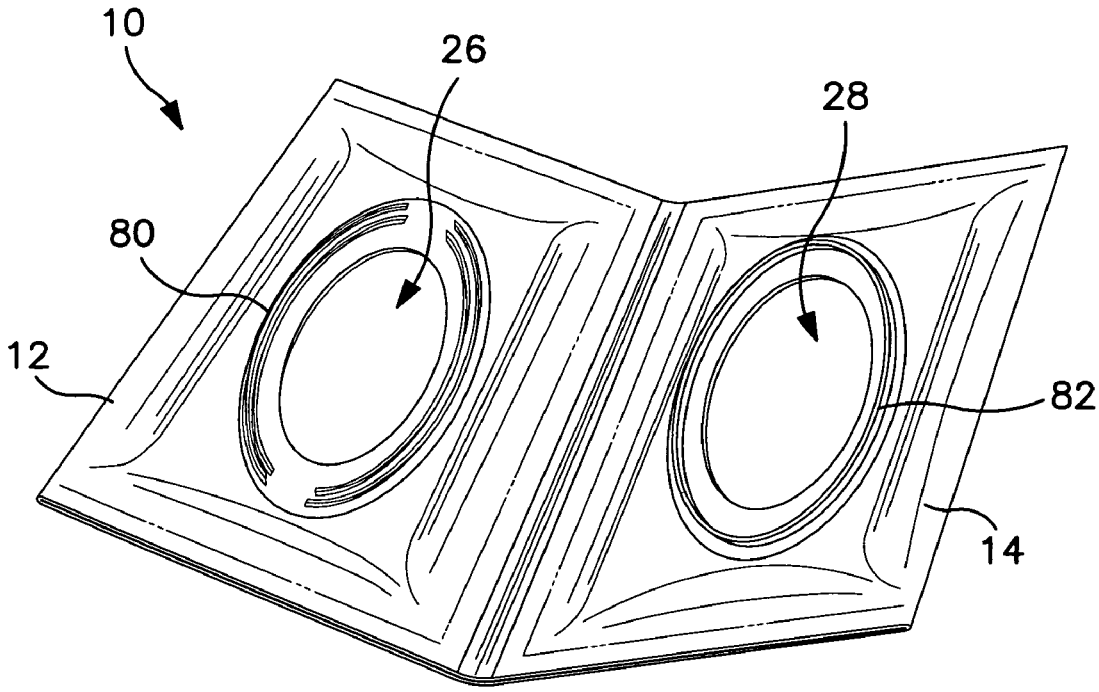
FIG. 4E is a perspective view of another embodiment of a package made in accordance with the present disclosure.
Figure 4F:
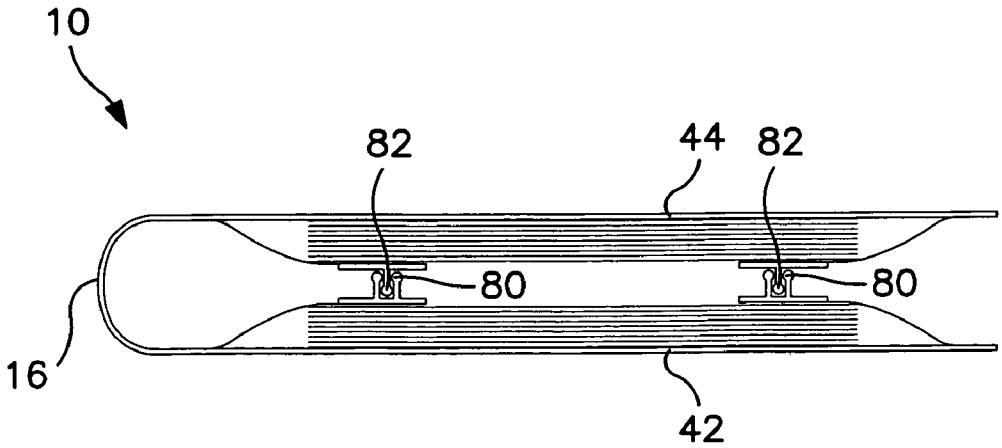
FIG. 4F is a cross-sectional view of the package illustrated in FIG. 4E.

Referring to FIGS. 4E and 4F, another embodiment of a sealing device that may be used with the package of the present disclosure is illustrated. In this embodiment, the first and second openings 26 and 28 generally align with one another when the package 10 is folded. The sealing member, in this embodiment, seals the first opening to the second opening when the package is folded.

For instance, the sealing member can include a female portion 80 that surrounds the opening 26. The sealing member can further include a male portion 82 that surrounds the opening 28. As shown in FIG. 4F, when the package 10 is folded, the female portion 80 forms an interlocking fit with the male portion 82.

In general, any suitable interlocking mechanical seal may be used to close the two openings. In the embodiment illustrated in FIGS. 4E and 4F, for instance, the female portion comprises a groove, while the male portion comprises a ridge. The ridge of the male portion fits within the groove of the female portion to close the openings.

In addition to a mechanical seal as shown in the figures, in other embodiments, other sealing type arrangements may be used. For instance, in one embodiment, each of the openings can be surrounded by a pressure sensitive adhesive that seals the openings together when the package is folded.

It should also be understood that the shape of the openings can vary and is generally not critical. For example, in the figures, the openings 26 and 28 have an oval shape. In other embodiments, however, the openings can be rectangular, square, circular or any other suitable shape as may be desired.

Figure 4G:
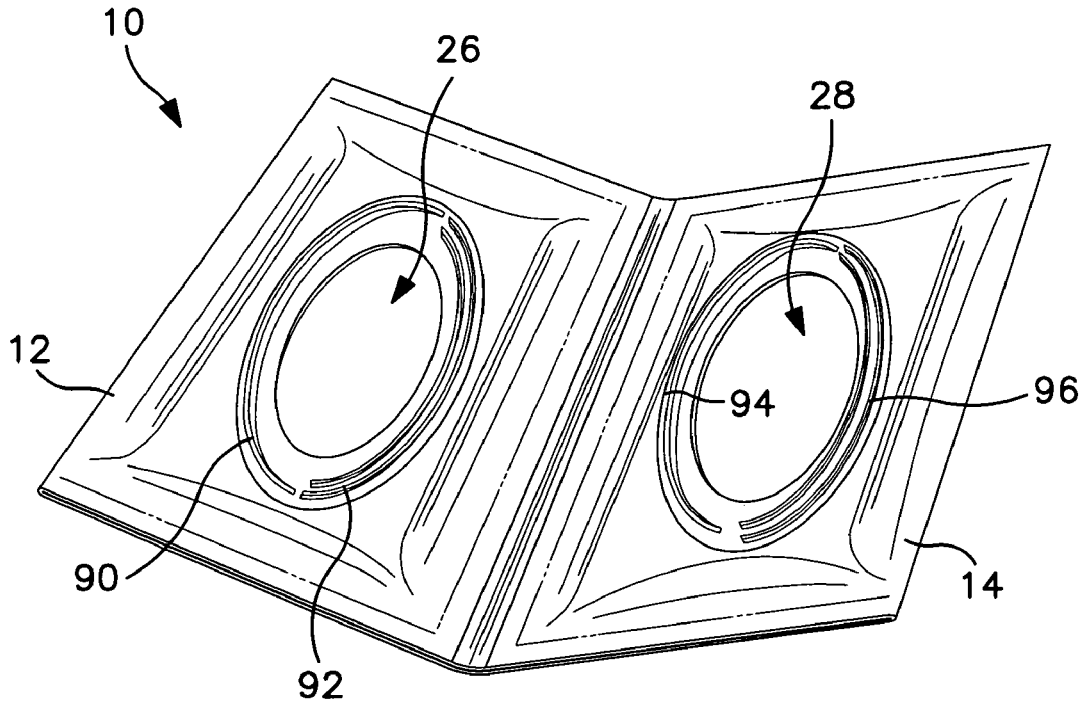
FIG. 4G is a perspective view of another embodiment of a package made in accordance with the present disclosure.

Referring to FIG. 4G, still another embodiment of a sealing device that may be used with the package of the present disclosure is illustrated. As shown, the embodiment illustrated in FIG. 4G is similar in construction to the embodiment illustrated in FIGS. 4E and 4F. Similar to the embodiments shown in FIGS. 4E and 4F, for instance, the sealing member seals the first opening to the second opening when the package is folded. In this embodiment, however, each opening is surrounded by both a male portion and a female portion. For example, as shown, the opening 26 is surrounded by a first male portion 90 and a first female portion 92. The opening 28, on the other hand, is surrounded by a second male portion 94 and a second female portion 96.

When the package illustrated in FIG. 4G is folded together, the first male portion 90 is received within the second female portion 96, while the second male portion 94 is received within the first female portion 92. In this manner, the first opening 26 is sealed to the second opening 28 when the product is folded.

The embodiment illustrated in FIG. 4G may provide various benefits and advantages during manufacture. For instance, by having each opening surrounded by a male portion and a female portion, each structure surrounding the opening is identical. In other words, only a single sealing structure needs to be manufactured. When assembling the product, a first sealing structure surrounds the first opening 26, while an identical sealing structure is placed around the opening 28, only the second structure is rotated 180° in relation to the first sealing structure.

Figure 4H:
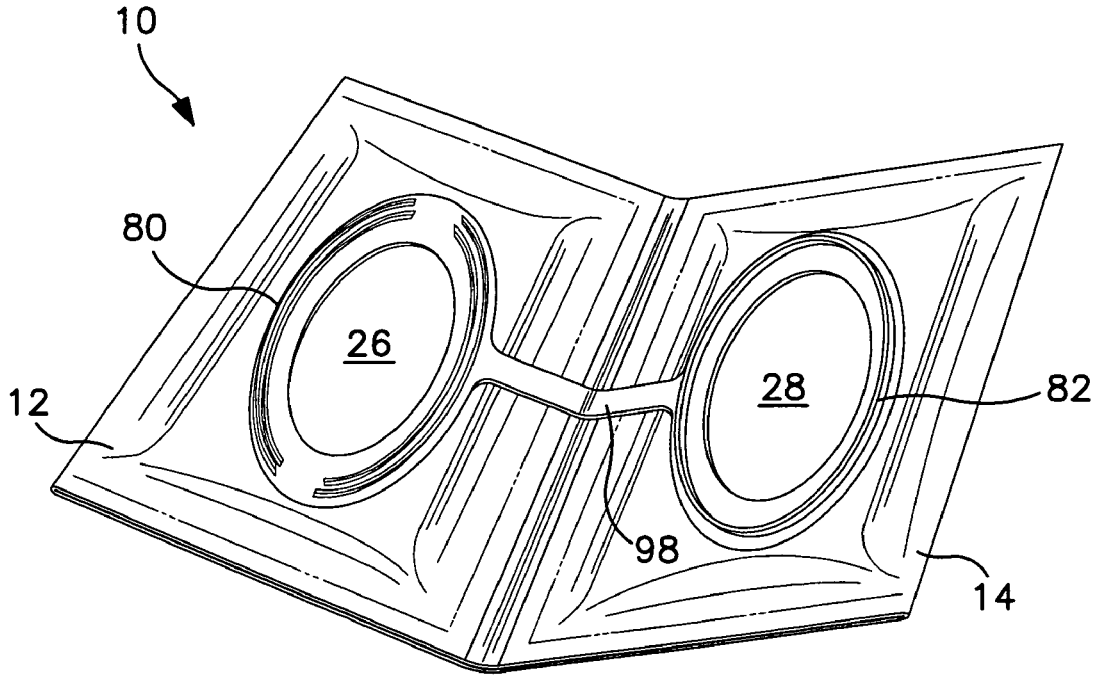
FIG. 4H is a perspective view of still another embodiment of a package made in accordance with the present disclosure.

Referring to FIG. 4H, still another embodiment of a package made according to the present disclosure is illustrated. Once again, the embodiment illustrated in FIG. 4H is very similar to the embodiment illustrated in FIGS. 4E and 4F. In particular, the package shown in FIG. 4H contains a sealing member that includes a female portion 80 that surrounds the opening 26 and a male portion 82 that surrounds the opening 28. When the package 10 is folded, the female portion 80 forms an interlocking fit with the male portion 82. In this embodiment, however, the package 10 further includes a tether 98 that connects the female portion 80 with the male portion 82. The tether 98 is provided in order to maintain the female portion and the male portion in alignment when the package is folded. The tether 98 can also be used to maintain the female portion and the male portion in alignment when the package is manufactured. In general, the tether 98 can be made from any suitable material. For instance, in one embodiment, the tether 98 may be made from a plastic film that is at least semi-rigid, but foldable with the seam.

In the embodiment illustrated in FIG. 4H, only a single tether 98 is shown. It should be understood, however, that in other embodiments the package may include more than one tether. For instance, in an alternative embodiment, a first tether may connect the top of the female portion with the top of the male portion and a second tether may connect the bottom of the male portion with the bottom of the female portion.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A package for carrying wipes comprising:

a first compartment containing a first stack of wipes, the first compartment having a length and a width and defining an inner surface and an outer surface;

a second compartment containing a second stack of wipes, the second compartment having a length and a width that are substantially similar to the length and width of the first compartment, the second compartment also defining an inner surface and an outer surface;

wherein the first compartment is connected to the second compartment along a seam and is foldable onto the second compartment about the seam, and wherein, when in a folded configuration, the inner surface of the first compartment faces the inner surface of the second compartment; and a first opening located on the inner surface of the first compartment for withdrawing wipes therethrough and a second opening located on the inner surface of the second compartment for also withdrawing wipes therethrough; and wherein the first and second openings are located on the first and second compartments respectively so as to overlap when the first compartment is folded onto the second compartment, and wherein the package further comprises a sealing member that surrounds the first opening and the second opening, the sealing member sealing the first opening to the second opening when the package is folded; the sealing member further comprising a tether that connects the first portion to the second portion, said tether width being smaller than the width of said inner surface of said first and said second compartments.

2. A package as defined in claim 1, wherein at least the first stack of wipes comprise pre-moistened wipes.

3. A package as defined in claim 1, wherein the sealing member comprises a female portion positioned adjacent to the first opening and a male portion positioned adjacent to the second opening, the female portion forming an interlocking fit with the male portion when the package is folded.

4. A package as defined in claim 1, wherein the sealing member comprises a first female portion and a first male portion positioned adjacent to the first opening and a second female portion and a second male portion positioned adjacent to the second opening, the first female portion forming an interlocking fit with the second male portion and the first male portion forming an interlocking fit with the second female portion when the package is folded.

5. A package as defined in claim 3, wherein the female portion comprises a groove that at least partially surrounds the first opening and the male portion comprises a ridge that at least partially surrounds the second opening.

6. A package as defined in claim 1, wherein the package is formed from a single blank of a polymeric material.

7. A package as defined in claim 1, wherein the first compartment and the second compartment are made from a multi-layered polymer film.

8. A package as defined in claim 7, wherein the multi-layered polymer film includes a sealable layer facing the stack of wipes in the first and second compartments and an outside layer.

9. A package as defined in claim 8, wherein the multi-layered polymer film further includes a core layer positioned in between the sealable layer and the outside layer, the core layer being more rigid than the sealable layer and the outside layer.

10. A package as defined in claim 8, wherein the sealable layer comprises a polyolefin, a copolymer of a polyolefin, or an ethylene vinyl acetate copolymer, the outside layer comprising a polyolefin or a copolymer thereof.

11. A package as defined in claim 7, wherein the multi-layered polymer film has been embossed.

12. A package as defined in claim 6, wherein the blank includes a first end and a second end, the first end having been folded over and attached to the blank to form the first compartment and the second end having been folded over and attached to the blank to form the second compartment.

13. A package as defined in claim 12, wherein the seam is formed from only one layer of the polymeric material.

14. A package as defined in claim 1, further comprising a perforation line located along the seam for separating the first compartment from the second compartment.

15. A package as defined in claim 1, wherein the first stack of wipes comprise a first wiper product and the second stack of wipes comprise a second wiper product, the first wiper product being different than the second wiper product.

16. A package as defined in claim 1, wherein the width and length of each compartment is from about 2 inches to about 6 inches.

17. A package as defined in claim 1, wherein the first compartment is formed from a first blank and the second compartment is formed from a second blank, the first and second blanks being connected together to form the seam.

18. A package as defined in claim 3, wherein said tether connects the female portion to the male portion.

19. A package as defined in claim 18, wherein the tether extends across the seam.

20. A package for carrying wipes comprising:

a first compartment containing a first stack of wipes, the first compartment having a length and a width and defining an inner surface and an outer surface;

a second compartment containing a second stack of wipes, the second compartment having a length and a width that are substantially similar to the length and width of the first compartment, the second compartment also defining an inner surface and an outer surface;

wherein the first compartment is connected to the second compartment along a seam and is foldable onto the second compartment about the seam, and wherein, when in a folded configuration, the inner surface of the first compartment faces the inner surface of the second compartment;

a first opening located on the inner surface of the first compartment for withdrawing wipes therethrough and a second opening located on the inner surface of the second compartment for also withdrawing wipes therethrough; and a sealing member that includes a first portion that surrounds the first opening and a second portion that surrounds the second opening, the sealing member for resealably closing the first and second openings, the sealing member further comprising a tether that connects the first portion to the second portion, said tether width being smaller than the width of said inner surface of said first and said second compartments.

21. A package as defined in claim 20, wherein the tether extends across the seam.

22. A package as defined in claim 20, wherein the first portion comprises a female portion and the second portion comprises a male portion, the female portion forming an interlocking fit with the male portion when the package is folded.

23. A package as defined in claim 22, wherein the female portion comprises a groove that at least partially surrounds the first opening and the male portion comprises a ridge that at least partially surrounds the second opening.

24. A package as defined in claim 20, wherein at least the first stack of wipes comprise pre-moistened wipes.

25. A package as defined in claim 20, wherein the package is formed from a single blank of a polymeric material.

26. A package as defined in claim 20, wherein the first compartment and the second compartment are made from a multi-layered polymer film.

27. A package as defined in claim 26, wherein the multi-layered polymer film includes a sealable layer facing the stack of wipes in the first and second compartments and an outside layer.

28. A package as defined in claim 25, wherein the blank includes a first end and a second end, the first end having been folded over and attached to the blank to form the first compartment and the second end having been folded over and attached to the blank to form the second compartment.

* * * * *